United States Patent [19]

Sloan

[11] Patent Number: 4,976,379

[45] Date of Patent: Dec. 11, 1990

[54] DISPENSING CONTAINER WITH INTEGRAL FUNNEL

[76] Inventor: Daniel C. Sloan, 2701 Riverside Dr., Ste. 208b, Coral Springs, Fla. 33065

[21] Appl. No.: 197,589

[22] Filed: May 23, 1988

[51] Int. Cl.[5] ..... B67B 7/24

[52] U.S. Cl. ..... 222/83; 222/89; 222/153; 215/256

[58] Field of Search ..... 222/83, 83.5, 88, 89, 222/461, 522, 525, 541, 153; 141/329, 330; 215/250, 253, 256

[56] References Cited

U.S. PATENT DOCUMENTS

| | | | |
|---|---|---|---|
| 2,165,825 | 7/1939 | Von Bultzingslower | 222/522 |
| 4,267,945 | 5/1981 | Maynard | 222/83.5 |
| 4,722,449 | 2/1988 | Dubach | 222/83 |
| 4,760,941 | 8/1988 | Salmon et al. | 222/83 |
| 4,779,764 | 10/1988 | Debetencourt | 215/250 |

*Primary Examiner*—H. Grant Skaggs
*Attorney, Agent, or Firm*—Malloy & Malloy

[57] ABSTRACT

A container and closure assembly including a funnel attached to a closure portion thereof and specifically to facilitate emptying of the contents of the container into a given receiving opening or receptacle, such as applying motor oil to the oil fill orifice located on a motor vehicle engine, without spilling the contents. A membrane is normally positioned in sealing relation to the open end of the container and the funnel is movable between an operative and an inoperation position and is specifically structured to puncture the membrane when in the operative position to allow free flow of the contents from the container through the funnel and into the receiving opening, port, etc.

7 Claims, 4 Drawing Sheets

DISPENSING CONTAINER WITH INTEGRAL FUNNEL

BACKGROUND OF THE INVENTION

1. Field of the Invention

The present invention relates to container closure assemblies incorporating a built-in funnel structure movable between an operative and an inoperative position to facilitate emptying of the containers thereof.

2. Description of the Prior Art

The present invention specifically relates to a dispensing container with integral funnel. One specific application is in the dispensing of fluids used in connection with motor vehicles, such as motor oil, transmission fluid, etc. Heretofore, automobile fluids have been dispensed with the aid of separate funnels and openers or oil can spouts. Disposable plastic oil containers with narrowed necks provided some improvement but still allowed age of spill part of the fluid when the user put the fluid into the fill hole.

In McIntosh U.S. Pat. No. 4,307,821 a container closure assembly is described in which a cap with internal threads with a piercing element is partially screwed onto an elongated externally threaded neck portion of a container. The assembly is held rigidly by a fracturable skirt which prevents the cap from being screwed onto the neck and hence puncturing the membrane until the end user determines to release the medicant. The user then removes the fracturable skirt and screws the top down onto the threaded neck portion of the container, thus puncturing the membrane. The user then unscrews the cap and pours out the medicant.

Previous to the McIntosh structure a patent granted to Henderson U.S. Pat. No. 2,771,218 shows a closure assembly, primarily intended for pharmaceutical products, which has a container in which its dispensing end is covered with a puncturable membrane. Similarly it also had a threaded cap with a conical piercing top. The cap is prevented from piercing the membrane by means of lugs projecting from the side walls of the container. When the user wishes to release the medicant he turns the threaded cap which fractures the radially projecting ridges and allows the cap to screw down and puncture the membrane. The cap is then unscrewed and the medicant is released.

Another patent which is pertinent is Ferris U.S. Pat. No. 3,109,562. In this patent a removable collar holds the cap and container firmly together. When the user wishes to release the medicant he removes the collar and unscrews the cap. The membrane is then pierced by a sharp knife or other such device.

Additional references pertinent to the structure of the subject invention include the U.S. Pat. Nos. to Bailen, 4,146,153; Wolf, 2,718,333; Malpas, 4,325,496; Genese, 4,196,475 and 4,203,443; Shiefken, 4,106,701; Beerman, 2,767,744; Cavazza, 4,346,820; Garcia, 4,497,351; and Portnoff, 4,475,914. In addition to the above noted U.S. patent the German Pat. No. 3,122,969 and the British Pat. No. 834,547 are also of interest.

SUMMARY OF THE INVENTION

In light of the problems existing in the prior art, as evidenced in part by the above noted patents, the following objects of the present invention are set forth. One object of the present invention is to provide an integrated container closure assembly and eliminate the necessity of using a separate funnel to pour the contents of the container into a fill hole (orifice) without unnecessary spillage onto the surrounding surfaces. To this end a leakproof funnel assembly is connected to the container section. Another object is to allow the user to start the fluid flow once the discharge end of the funnel is fully into the fill hole or orifice. This eliminates wasteful spillage and keeps the surfaces surrounding the fill hole free from said fluid which may corrode adjacent parts and/or may cause noxous smoke to be produced if the surfaces are hot. Yet another object of the present invention is to eliminate the necessity of using a separate device to open the fluid container, as is required for the opening of many types of containers containing automotive fluids. Another object is to provide a consistent container format for all types of automotive fluids for machine vending of color coded and suitably labeled automotive fluids. Further objects and advantages of my invention will become apparent from a further consideration of the drawings and ensuing description thereof.

To these ends the container portion of the present invention has an elongated neck with two or more longitudinal ridges along its surface, two or more locking tabs or resilient protrusions, and a puncturable airtight membrane. The funnel component contains mating longitudinal grooves, suitable recesses to engage the locking tabs, a blade to pierce the membrane, an elongated discharge neck, and a removable retaining collar assembly which may be removed by a container pull-tab. The retaining collar holds the container and funnel assembly rigidly together and out of operative position prior to desired use.

BRIEF DESCRIPTION OF THE DRAWINGS

These and other objects of the present invention and the various features and details of the construction and operation of a container closure assembly with integral funnel in accordance with the present invention are hereinafter more fully set forth with reference to the accompanying drawings, wherein.

Like references refer to like parts throughout the several views of the drawings.

DESCRIPTION OF THE PREFERRED EMBODIMENT OF THE INVENTION

Figure 2:
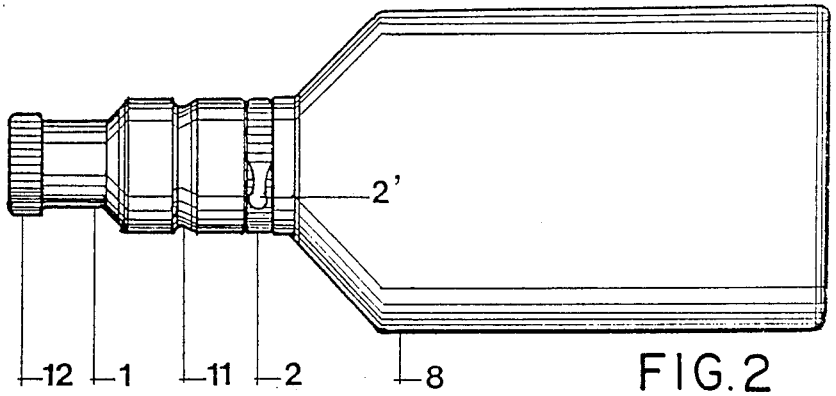
FIG. 2 is a side elevational view of the assembled container enclosure assembly of the present invention in its assembled form.
Figure 3:
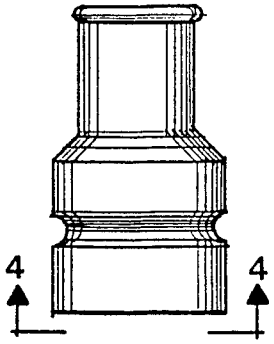
FIG. 3 is a front plan view in detail of the exterior of the funnel structure of the present invention.
Figure 4:
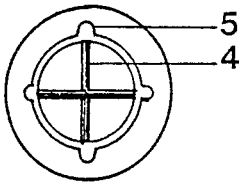
FIG. 4 is a bottom end view along line 4—4 of FIG. 3.
Figure 1:
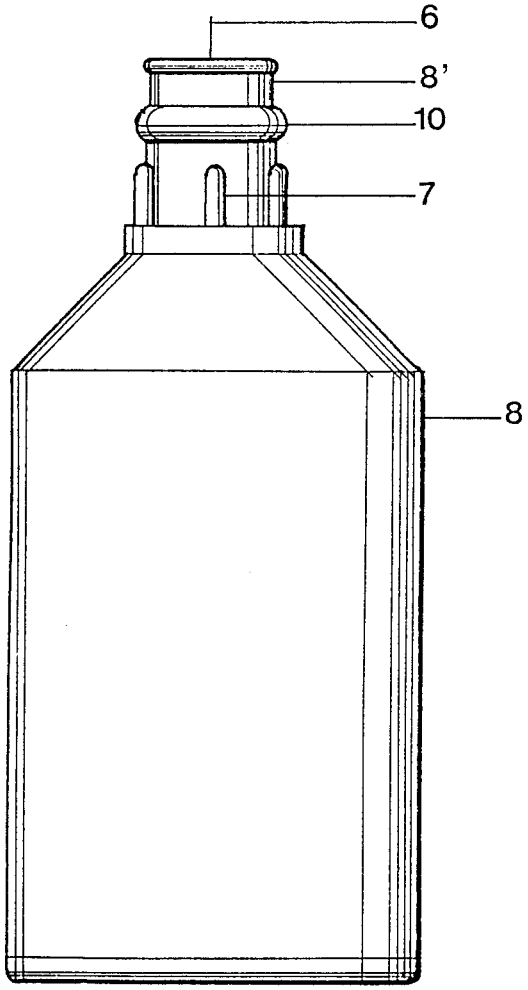
FIG. 1 is a front plan view of the container assembly of the present invention absent the inclusion of a funnel structure thereon.
Figure 5:
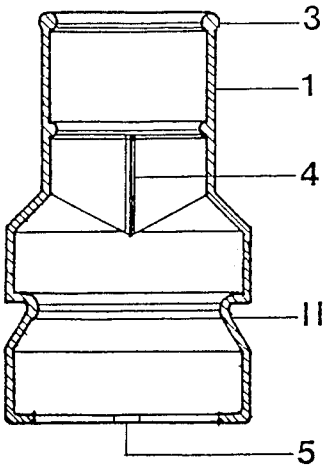
FIG. 5 is a longitudinal sectional view showing interior structural details of the funnel structure of FIG. 3.
Figure 6:
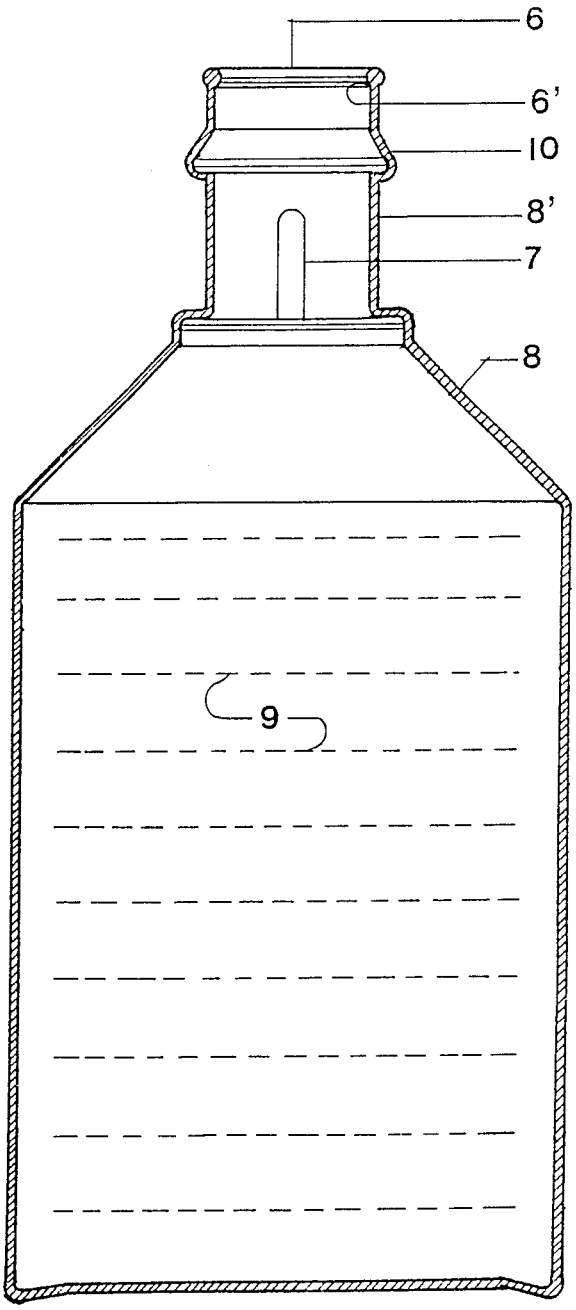
FIG. 6 is a longitudinal sectional view of the container body.
Figure 7:
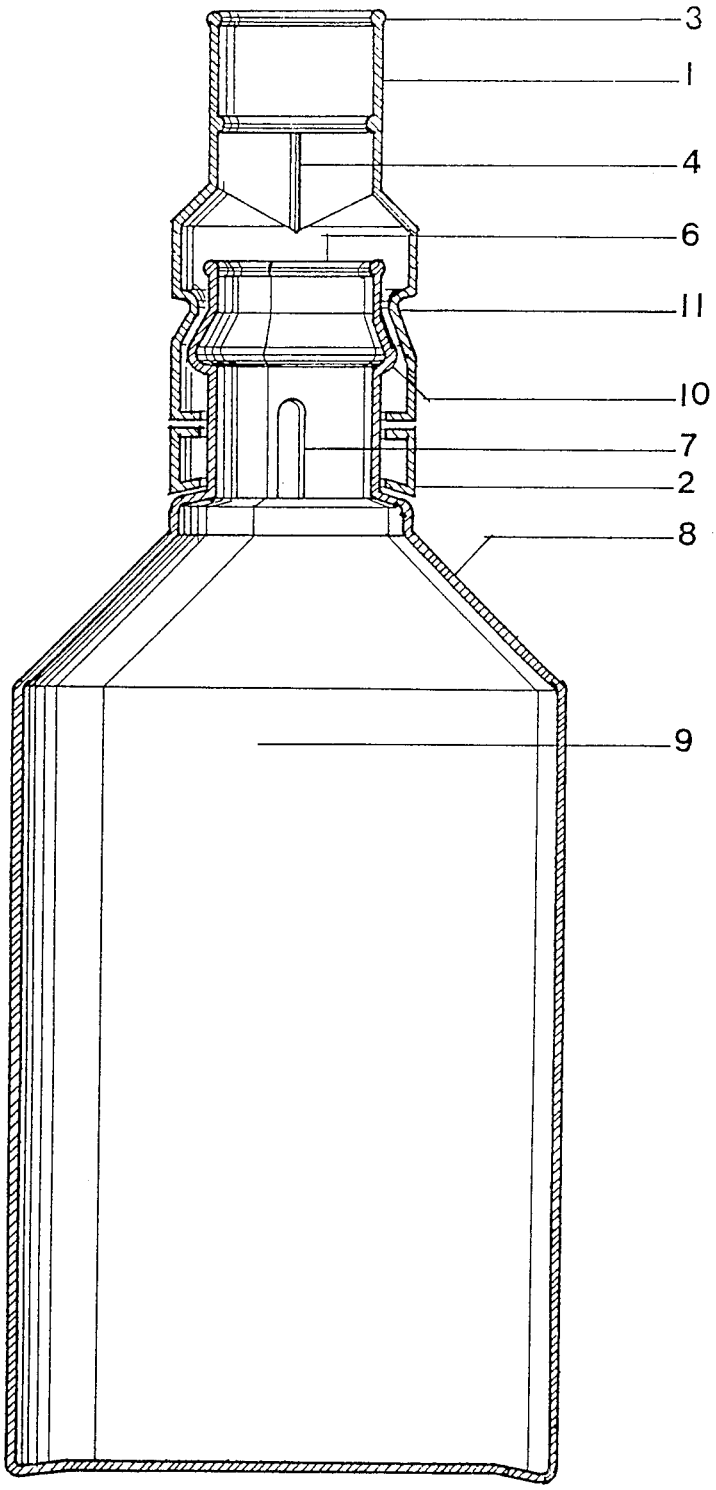
FIG. 7 is a longitudinal sectional view of the assembled container and closure assembly in its inoperative, non-pouring position.
Figure 8:
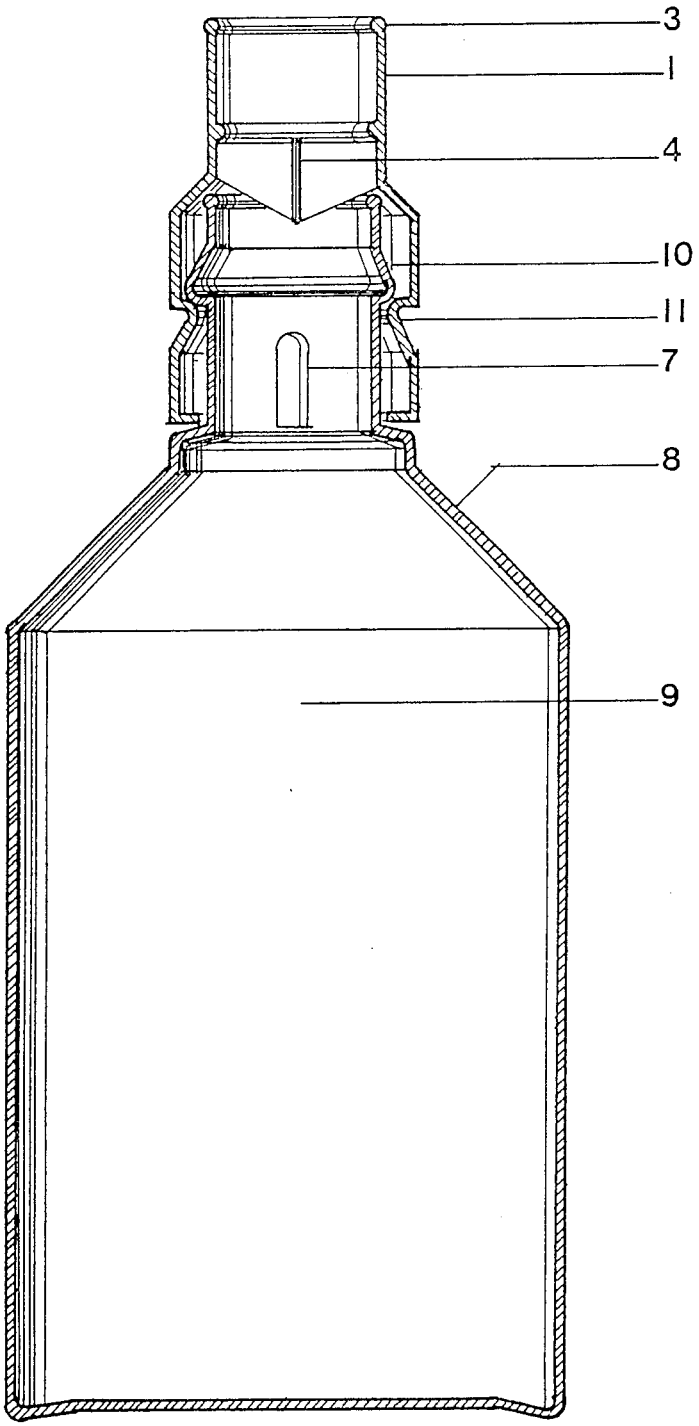
FIG. 8 is a sectional view of the embodiment of FIG. 7 in an operative pouring position.

The invention in its preferred embodiment comprises two components as shown in FIGS. 1–4. The first component is the funnel component 1, shown in FIG. 3 and FIG. 5. This component directs the flow of fluid and contains a retaining means in the form of a retaining collar assembly 2 having a pull tab construction as at 2', made from a frangible or tearable material and which holds the funnel component and the container component in a fixed relationship to each other and out of an operative pouring position as shown in FIG. 8. This position also prevents the blade structure 4 from the penetration of membrane 6 prior to use. FIG. 5 and FIG. 6 also show a drip proof lip 3 on the funnel structure 1 as well as the blade 4. The funnel structure 1 also contains guide grooves 5 (see FIG. 4) designed to receive ribs 7 (see FIG. 1). The second component of this invention is the container 8 shown in FIGS. 1, 6 and 7. The container 8 includes neck portion 8' having a thin plastic or foil material membrane 6 sealing the open end 6' communicating with the contents of the container 8 as represented as 9 in FIG. 6. Guide fingers 7 are formed of plastic (or other material) and secured to the neck 8'. Plastic locking parts or like protruding plastic members as at 10 and 11 are secured to neck 8' and funnel 1 respectively, as shown in FIGS. 5 and 6. The circumferential locking ridge 11 as shown in FIG. 5 engages the locking part 10 and initially maintains the funnel 1 out of operative position. A dust cap 12 is provided (see FIG. 2) to keep foreign matter out of the funnel component prior to use.

The operation and use of the container closure assembly with an integral funnel incorporating the features of the present invention will now be described. As is customary the container body portion 8 is filled with a fluid or other material 9 and then sealed with the application of the membrane 6 over open end 6'. The closure with integral funnel is then assembled by aligning the guide fingers or ribs 7 and guide grooves 5 and pushing the funnel 1 onto the container body 8 until the locking parts 10 engage the first locking ridge 11. The retainer means includes the collar assembly and comprising a pull tab collar is then sealed to both the funnel 1 and the container body 8 in surrounding relation to neck 8' by heat welding or other means. Lastly the dust cap 12 is placed over the end of the funnel outer open end and about lip 3 to keep foreign matter out prior to use.

Now when it is desired to dispense the container contents the user simply removes the dust cap 12, and then pulls the pull tab 2' of retaining collar 2 until removed from its surrounding position on the neck 8' of the container. This allows, through application of proper force, the funnel component to slide further along the neck 8' of the container component 8. The user then places the end of the funnel component into the fill hole (not shown for purposes of clarity). Then while securely holding the funnel 1 in one hand, the user pushes the container 8 with the other hand, causing the funnel 1 to slide further onto the neck 8' of the container 8 and hence the blade 4 is forced into engagement with and punctures the plastic or foil membrane 6. This in turn allows the contents 9 to flow into the fill hole. The locking parts 10 and 11 maintain the funnel 1 fully onto an outer part of neck 8' the container 8 prior to forming the blade 4 into penetrating relation with membrane 6. As best shown in FIGS. 7 and 8 the locking parts 10 and 11 are disposed for interruptive engagement with one another such that the funnel 1 is maintained out of operative position, initially, due to the interruptive position of the locking member 10. However, upon applying an external force to the funnel structure 1 and the container 8, the members 10 and 11 will be forced beyond one another due to the flexibility of the material into the operative position as shown in FIG. 8. The respective locking members 10 and 11 will then be disposed in a "reversed" interruptive and abutting engagement with one another so as to maintain the funnel structure 1 in the aforementioned operative position as clearly shown in FIG. 8. Once the container 8 is empty the unit is discarded.

In summary, therefore, the present invention provides a spill proof, convenient, and simple method to transfering fluids from a container into a fill hole or like orifice or a machine or any secondary container, without the use of a separate funnel or opening device and affords the user complete control during dispensing. This is accomplished by allowing the user, prior to pouring, to put the discharge end of the funnel 1 fully into a fill hole prior to piercing the membrane 6 and beginning the discharge of the contents 9.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to falling within the scope of the invention as claimed. Nor is it desired to limit the application of the present invention solely for use in conjunction with automobile fluids. For example, the invention could be utilized for a wide variety of products including fluids and granulated materials.

What is claimed is:

1. A container enclosure assembly designed to facilitate emptying of the contents thereof without spillage, said assembly comprising:

a. a container body comprising a hollow interior in which a product may be stored, b. an outlet portion formed on said body and including a substantially elongated neck having one open end and an opposite end formed on said neck adjacent said body and in communicating relation with said hollow interior, c. a membrane formed of a rupturable material and disposed in covering, sealing engagement with said open end of said neck, whereby product within said hollow interior is prevented from exiting therefrom through said open end, d. funnel means for directing flow out of said container body movably mounted on said neck along the length thereof and including an outer open end disposed and aligned in communicating relation with said open end of said neck and an open inner end including a periphery disposed in surrounding relation to said neck, e. stop means resisting axial displacement of said funnel means relative to said outlet portion and into an operative position and comprising a first stop portion and a second stop portion formed on an external surface of said neck and on an internal surface of said funnel means respectively, f. said first and second stop portions each including an integrally formed protrusion having a substantially continuous annular configuration mounted on said external surface of said neck and on said internal surface of said funnel means respectively, said protrusions formed of a flexible material and disposed in abutting, interruptive relation to one another, g. said protrusions disposed to initially resist displacement of said funnel means along the length of said neck into said operative position and structured to include sufficient flexability to force passage of said protrusions of said first and second stop portions beyond one another in opposite directions and into said operative position upon application of an opposing external, axially applied force to said funnel means and said container body concurrently, h. a retension means removably mounted on said neck in interruptive relation to passage of said funnel means along the length of said neck for preventing movement of said funnel means into said operative position, i. guide means formed both on said neck and said funnel means in alignable relation to one another for facilitating linear displacement of said funnel means relative to said neck, j. said guide means comprising a plurality of elongated ribs formed on said neck and extending along a major portion of the length thereof and a plurality of channels formed on said periphery of said open inner end of said funnel means, said plurality of ribs and said plurality of channels disposed in aligned relation to one another and movably relative to one another into sliding engagement, said rib elements and said plurality of channels, when cooperatively engaged, being disposed and dimensioned to allow linear movement and prevent rotational movement of said funnel means relative to said neck, k. said funnel means further structured to penetrate said membrane and access said hollow interior upon forcing of said funnel means into said operative position, and l. said operative position further defined by an open path of product flow from said hollow interior through said open end of said neck to said outer open end of said funnel means.

2. An assembly as in claim 1 wherein said retention means comprises a collar positionable in surrounding relation to said neck and mounted thereon in blocking engagement with an inner end with said funnel means and an adjacently disposed base of said neck.

3. An assembly as in claim 2 wherein said collar is formed from a frangible material and is removable from said blocking engagement with said funnel means, whereby said funnel means is positionable in said operative position upon removal of said collar means and application of said external forces.

4. An assembly as in claim 1 further comprising a cap structure removably disposed in covering relation to said outer open end of said funnel means.

5. An assembly as in claim 4 further comprising said funnel means having a rupturing means and movable therewith in aligned, interruptive relation to said membrane for rupturing said membrane and establishing said open path of product flow when said funnel means is forced into said operative position.

6. An assembly as in claim 5 wherein said rupturing means further comprises a blade structure mounted on said funnel means and movable therewith in a direction of travel perpendicular to said membrane and configured to cut through said membrane upon force of positioning of said funnel means into said operative position.

7. An assembly as in claim 6 wherein said blade comprises a plurality of blade segments disposed in transverse intersecting engagement with one another and a plurality of open passages extending between said blade segments and defining a path of product flow from said container to said open end of said funnel means.

* * * * *